United States Patent [19]

Platt et al.

[11] 4,151,023

[45] Apr. 24, 1979

[54] METHOD FOR THE PRODUCTION OF A NONWOVEN FABRIC

[75] Inventors: Louis Platt, Seneca; Marvin Wishman, Greenville, both of S.C.; David R. Gentry, Chamblee, Ga.; Jake E. Williams, Rockwall, Tex.

[73] Assignee: Phillips Petroleum Company, Bartlesville, Okla.

[21] Appl. No.: 804,196

[22] Filed: Jun. 6, 1977

Related U.S. Application Data

[62] Division of Ser. No. 610,899, Sep. 5, 1975, Pat. No. 4,042,655.

[51] Int. Cl.[2] ..... B32B 27/02; D04H 1/54

[52] U.S. Cl. ..... 156/62.2; 156/181; 156/229; 156/272; 156/306; 264/126; 264/289; 428/91; 428/296

[58] Field of Search ..... 156/62.4, 272, 62.6, 156/62.2, 229, 296, 496, 181, 306; 19/155, 156, 242, 250, 299, 308; 264/126, 288, 289, 25; 428/91, 280, 288, 296

[56] References Cited

U.S. PATENT DOCUMENTS

| | | | |
|---|---|---|---|
| 2,467,291 | 4/1949 | Brelsford et al. | 156/229 |
| 2,804,120 | 8/1957 | Dancewicz | 156/496 |
| 2,959,509 | 11/1960 | Marshall | 156/283 |
| 3,357,878 | 12/1967 | Newman | 156/296 |
| 3,619,337 | 11/1971 | Weedon et al. | 428/91 |
| 3,676,245 | 7/1972 | Helmut et al. | 156/62.6 |
| 3,836,416 | 9/1974 | Ropiequet | 156/181 |
| 3,856,602 | 12/1974 | Colijn et al. | 156/62.4 X |

FOREIGN PATENT DOCUMENTS 982801 2/1965 United Kingdom.

*Primary Examiner*—Michael G. Wityshyn

[57] ABSTRACT

A nonwoven fabric is produced by forming a batt comprising staple fibers oriented primarily in the fill direction, drafting the batt in the warp direction in a first warp-drafting zone, needling the drafted batt, drafting the needled batt in the warp direction in a second warp-drafting zone, and drafting the warp-drafted, needled batt in the fill direction in a fill-drafting zone. A fabric, apparatus for producing the fabric, and a method for fusing a nonwoven batt are provided.

5 Claims, 5 Drawing Figures

METHOD FOR THE PRODUCTION OF A NONWOVEN FABRIC

This application is a division of copending application Ser. No. 610,899, filed Sept. 5, 1975 and now U.S. Pat. No. 4,042,655, issued Aug. 16, 1977.

BACKGROUND OF THE INVENTION

The invention relates to a nonwoven fabric, a method for fusing a nonwoven batt, and a method and apparatus for producing a nonwoven fabric.

In the last twenty-five years or so the development of polymeric materials has seen a tremendous growth. Polymeric materials lend themselves to a vast number of uses and applications. One of the more significant areas in which polymeric materials have been used is in the textile industry. The melt spinning of thermoplastic synthetic materials to produce continuous filaments, staple and yarns of such materials has revolutionized the textile industry.

Although much of the growth in the use of synthetic filaments has been in the use of knitted or woven fabrics, nonwoven materials of synthetic filaments also have experienced substantial growth. There are a number of methods known today for producing nonwoven fabrics from synthetic filaments and mixtures of natural and synthetic filaments. Nonwoven fabrics find a variety of uses. A specific area in which nonwoven fabrics have gained substantial acceptance is in the manufacture of carpets, particularly as the primary and/or secondary backing material. Since nonwoven fabrics made of synthetic fibers resist deterioration caused by mildew much better than jute, the material generally used, carpets made using synthetic nonwoven fabrics as the backing material are excellent carpets for use in areas exposed to moisture, such as patios and other outdoor areas.

Nonwoven fabrics are being used in many other areas as well. For example, nonwoven fabrics both fused and unfused are used as substrates in the production of various laminates and as ticking material in the furniture industry. Although nonwovens are useful in a variety of applications as indicated above, nonwoven fabrics can still be substantially improved especially with regard to their dimensional stability, strength and methods of fusing the nonwoven fabric.

It is an object of the present invention to produce a nonwoven fabric.

Another object of the invention is to produce a nonwoven fabric with improved dimensional stability and stength as compared to nonwoven fabrics known in the art.

Another object of the present invention is to provide a fused nonwoven fabric in which the depth of fusion is controlled and the integrity of the fibers' cross section is maintained.

Other objects, aspects and advantages of the invention will be apparent after studying the specification and the appended claims.

SUMMARY

According to the invention a novel nonwoven fabric is produced by forming a batt comprising fibers oriented primarily in the fill direction, drafting the batt in the warp direction in a first warp-drafting zone, needling the drafted batt, drafting the needled batt in the warp direction in a second warp-drafting zone, and drafting the warp drafted, needled batt in the fill direction in a fill-drafting zone.

Further according to the invention, apparatus is provided suitable for the production of the novel fabric comprising, in combination, means for forming a batt of fibers, carrier means for receiving the batt from the forming means and transporting the batt of fibers, first warp-drafting means for receiving the batt of fibers from the carrier means and drafting the batt in the warp direction, needling means for needling the warp-drafted batt, second warp-drafting means for drafting the needled batt in the warp direction and fill-drafting means for drafting the needled warp-drafted batt in the fill direction.

Further according to the invention, a method is provided for fusing a nonwoven batt of synthetic fibers wherein the depth of fusion is controlled and the integrity of the fiber cross section is maintained after fusion comprising subjecting at least one side of the batt to infrared radiation until the desired depth of fusion is obtained.

BRIEF DESCRIPTION OF THE DRAWING

To further describe the invention the attached drawing is provided in which.

DETAILED DESCRIPTION OF THE INVENTION

Figure 1:
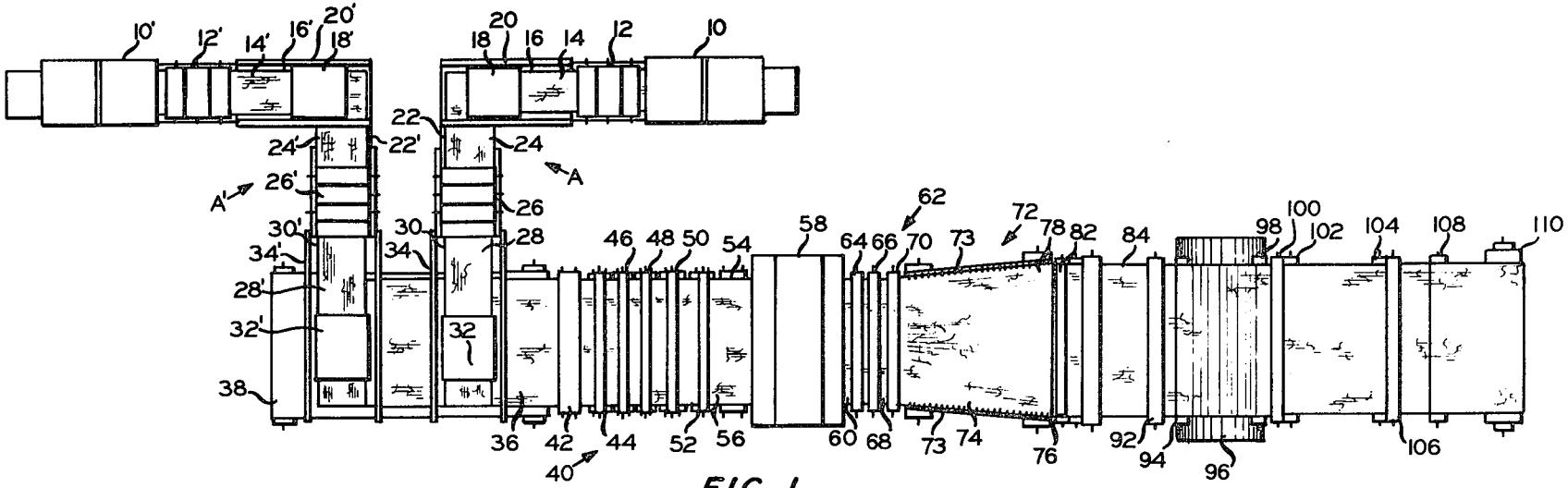
FIG. 1 is a top view of the schematic representation of an embodiment of the apparatus of the invention.
Figure 2:
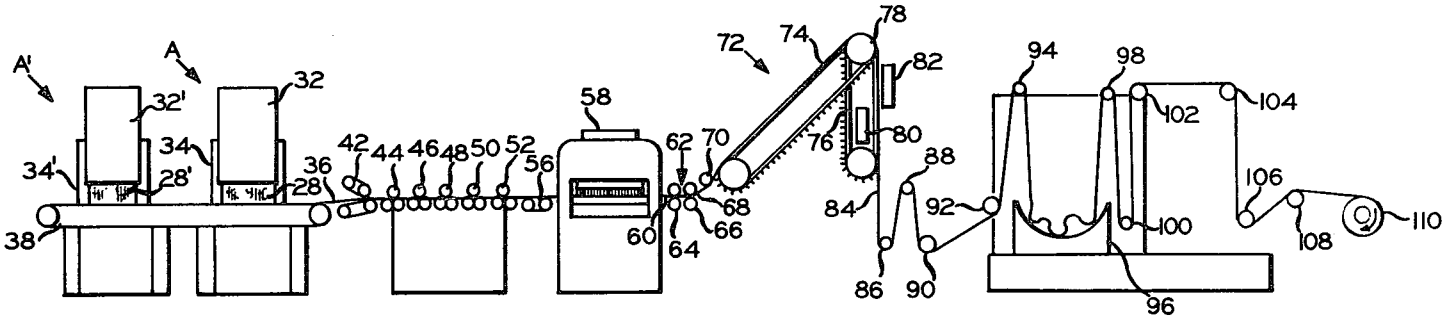
FIG. 2 is an elevational view of the apparatus of FIG. 1.

The apparatus of the invention is more fully understood by referring to the drawings and in particular FIGS. 1 and 2 wherein the embodiment of the apparatus shows a batt-forming means comprising two web-forming trains A and A' in which feed means 10,10' such as bale breakers, blender boxes, feed boxes, etc., feed fibers in the form of staple, such as polypropylene staple, to breaker carding machines 12,12'. The carding machines 12,12' produce carded webs 14,14' of fibers which are picked up by the takeoff aprons 16,16' of crosslappers 20,20'. Crosslappers 20,20' also comprise lapper aprons 18,18' which traverse a carrier means, such as intermediate aprons 22,22', in a reciprocating motion laying the webs 14,14' to form intermediate batts 24,24' on the intermediate aprons 22,22'. The intermediate batts 24,24' are passed to finisher carding machines 26,26' by intermediate aprons 22,22'. Carding machines 26,26' produce carded webs 28,28' which are picked up by takeup aprons 30,30' of crosslappers 34,34'. Crosslappers 34,34' also comprise lapper aprons 32,32' which form a batt of fibers 36 as the lapper aprons 32,32' traverse floor apron 38.

The carded webs 28,28' are laid on floor apron 38 to build up several thicknesses to produce batt 36. It is pointed out that only a means for forming a batt with the fibers oriented primarily in the fill direction is essential to practice the invention which can be accomplished by any suitable means. As an example, only one feed means, carding machine, and crosslapper are actually needed to form a batt. The use of two carding machines such as a breaker carding machine and a finisher carding machine and associated aprons and crosslappers are not essential to practice the invention. The use of two carding machines tends to open up the fibers better to form a more uniform web and to provide some randomization of the staple fibers forming the webs which form the batt; however, the fibers of batt 36 are still primarily oriented in the fill direction. Two web-forming trains A and A' or more are used to increase the speed of the overall operation, and thus are optional.

As used throughout the specification and claims, the term "fill direction" means the direction transverse to the direction of the batt on floor apron 38. The term "warp direction" means the direction parallel to the direction the batt moves on floor apron 38.

A first warp-drafting means 40, comprising at least two sets of nip rolls or an inlet apron 42 and one set of nip rolls 44, is used to draft batt 36. As used herein the terms stretching, drawing and drafting are synonymous. In FIGS. 1 and 2 the first warp-drafting means comprises five sets of nip rolls 44, 46, 48, 50 and 52 and inlet apron 42 and outlet apron 54. Each set of nip rolls is shown as a one-over-two configuration, which works very well, but almost any arrangement can be used, such as a one-over-one, two-over-one, etc., as well as mixtures of nip roll configurations. The warp-drafted batt 56 then is passed to needle loom 58 wherein the batt is needled at a density in the range of 100 to 1000 punches per square inch and at a penetration in the range of from about ¼ inch to about ¾ inch. One or more needle looms can be used. The needle looms can be either single needle board or a double needle board looms.

The warp-drafted, needled batt 60 is again drafted in the warp direction by a second warp-drafting means 62 comprising at least two sets of nip rolls 64 and 66 or an inlet apron and one set of nip rolls (not shown). The needled batt 68 which was drafted in the warp direction both before and after needling is passed over roll 70 to the fill-drafting means, such as tenter frame 72. As shown clearly in FIG. 2, tenter frame 72 comprises the fill-drafting section 74 and the tensioning section 76. Tensioning section 76 is not used to draft the batt, but to subject the batt to tension in the fill direction.

The fill-drafted batt can be fused using infrared radiation while the batt is subjected to tension in the fill direction. Infrared heaters 80 and 82 are shown in FIG. 2 positioned adjacent to and on opposite sides of unfused fabric 78. Either or both heaters can be used depending on the fusion desired. It is understood that the present invention is not limited to a fused product and a commercial grade unfused fabric is produced by the invention by not employing the infrared heaters 80 and 82. Thus the unfused product is rolled up subsequent to fill-drafting section 74.

Also it is understood that a fused fabric is produced according to the invention by employing various other fusion means, such as hot rolls, a hot fluid chamber and the like. It is preferred to fuse the fabric subjected to tension in the fill direction because a fabric produced in this manner has much improved strength and dimensional stability. Although other means can be used, it is preferred to fuse the fabric using infrared radiation because the depth of fusion can be controlled and the integrity of the fibers' cross section is maintained. If a hot fluid chamber is used as the fusion means, the depth of fusion is very difficult to control, if not impossible, and the equipment needed to simultaneously subject the unfused batt to tension in the fill direction and the hot fluid would be relatively expensive. If hot rolls are used to fuse the batt, the batt is primarily fused on the surface with little or no depth control, and the fibers on or near the surface are flattened, destroying the fibers' cross section and thus weakening the ultimate fabric by weakening the fibers.

The fused or unfused fabric 84 is normally passed to a suitable surge means such as "J" box 96 and rolls 86, 88, 90, 92 and 94. From the surge means the fabric is passed to a windup means 110 over a plurality of rolls, surge and idler rolls, 98, 100, 102, 104, 106 and 108.

As shown in the drawing, synthetic thermoplastic fibers in the form of staple are passed to carding machines 12,12' to produce carded webs 14,14'. The carded webs 14,14' are picked up by takeoff aprons 16,16' of crosslappers 20,20'. Lapper aprons 18,18' lay the carded webs on intermediate aprons 22,22' to produce an intermediate batt 24,24' which is passed to carding machines 26,26' to produce carded webs 28,28'. The carded webs 28,28' are picked up by takeoff aprons 30,30' of cross-lappers 34,34' and these carded webs 28,28' are laid on floor apron 38 by lapper aprons 32,32' to produce a batt 36. The number of webs used to form batt 36 depends upon a number of variables, such as the desired weight of the batt, the weight of the webs, the amount the batt is drafted during the process, etc. The batt 36 is then drafted in the warp direction by suitable means, such as the five sets of nip rolls 44, 46, 48, 50 and 52. When using nip rolls to practice the invention, only two sets of nip rolls actually are required to draft the batt; however, the use of more than two sets of nip rolls, such as the five nip rolls shown, provides a more uniform drafting since between any set of nip rolls a smaller drafting ratio can be used and still obtain the overall desired drafting ratio. In addition, the batt is frequently drafted between the nip formed by the feed apron and the first set of nip rolls 44. The batt 36 is drafted because each set of nip rolls is operated at a successively higher speed than the speed of the preceding inlet apron or set of nip rolls. Generally it has been found that utilization of more sets of nip rolls and smaller draft ratios between each set of nip rolls produces a more uniform fabric than utilization of fewer sets of nip rolls with higher draft ratios; however, at some point additional sets of nip rolls with reduced draft ratios between each set of nip rolls will not improve the product. In addition, there is a maximum speed at which the batt at a given weight can be produced due to the limitations of the batt-forming equipment. Thus, as in almost any process, the most economical operation requires consideration of a number of variables, and in particular the various parameters of the material processed. For example, some of the variables of the processed material which affect the drafting process are staple polymer, staple length and denier, staple finish, degree of crimp, weight of the batt, etc. Generally from about 2 to about 6 sets of nip rolls are utilized with an overall draft ratio ranging from about 1.01 to about 4 and a maximum draft ratio between sets of nip rolls of 2. However, a very good product is produced utilizing from about 3 to 5 sets of nip rolls with an overall draft ratio ranging from about 1.2 to 1.8 and a maximum draft ratio between sets of nip rolls of 1.3.

The warp-drafted batt 56 is then passed to needle loom 58 wherein the batt is needled to make a more coherent material. As stated above, one or more needle looms can be used and in addition each needle loom can be a double board needle loom. It is noted that the batt will experience some drafting as it passes through the needle loom which must be taken into consideration in determining the operating speeds of equipment positioned subsequent to the needle loom. It is not uncommon to experience drafting at a ratio in the range of from about 1.3 to about 2, employing one single board needle loom or one double board needle loom. The larger drafting ratios in the above range are normally experienced using a double needle board loom.

The warp-drafted, needle batt is again drafted in the warp direction in a second warp-drafting means 62, such as employing nip rolls 64 and 66, and operating the speed of nip rolls 66 at a slightly higher speed than nip rolls 64. The draft ratio employed in the second warp-drafting zone is also selected depending upon the material processed. Generally the draft ratio in the second warp-drafting zone ranges from about 1.01 to about 2; however, a good product is produced utilizing a draft ratio ranging from about 1.3 to about 1.5.

Needled batt 68 which has been drafted in the warp direction both before and after needling is then passed to a fill-drafting zone, indicated by tenter frame which drafts the batt in the fill direction through the use of diverging tracks 73 which grasp the fabric at the inlet and draft the fabric as the tracks slowly diverge from one another. The fill-drafting ratio depends upon a number of variables, such as staple length, denier, batt weight, needle density, etc. Generally the fill-drafting ratio ranges from about 1.01 to about 1.5; however, a fill-drafting ratio ranging from about 1.1 to about 1.3 produces a good product. Tenter frame 72 also contains a tensioning zone 76 which applies tension to the fabric or the fill-drafted batt 78 while the fabric is subjected to some form of fusion to fuse the staple filaments of the fabric together such as infrared radiation. As noted above, the broad invention contemplates the production of an unfused as well as a fused fabric. Thus one can practice the present invention even though the fill-drafted fabric 78 is not fused.

After the fabric passes the fill-tensioning zone 76 of tenter frame 72 the fabric 84 is passed to a surge zone such as "J" box 96 over a plurality of rolls and onto a takeup zone indicated by takeup means 110.

Various synthetic thermoplastic staple can be used in accordance with the present invention. For example, polyolefins such as polypropylene, polyesters such as polyethylene terephthalate, polyamides such as polycaprolactam, and mixtures thereof are suitable. Particularly good results have been obtained employing polypropylene staple. Also it is possible to use mixtures of natural and synthetic fibers in accordance with the present invention.

The synthetic staple suitable for use in applicant's invention can be selected from staple having a length ranging from $1\frac{1}{2}$ to about 10 inches. Good results have been obtained employing a staple length ranging from about $2\frac{1}{2}$ inches to about 4 inches. Staple denier can be selected from a wide range of deniers. Normally the denier ranges from about 1 to about 20; however deniers ranging from about 1.5 to about 8 are more common.

An important advantage of the present invention is in the reduction of the traversal rate or speed of the lapper apron without a corresponding decrease in production. Also in the production of very light fabrics, web weights can be maintained sufficiently high so as to preclude doffing problems encountered with some prior art processes.

In accordance with another aspect of the present invention, a nonwoven batt of synthetic fibers is fused by subjecting the batt to infrared radiation. By using infrared radiation to fuse a nonwoven batt, the depth of fusion can be controlled and the integrity of the fiber cross-section can be maintained after fusion.

Figure 3:
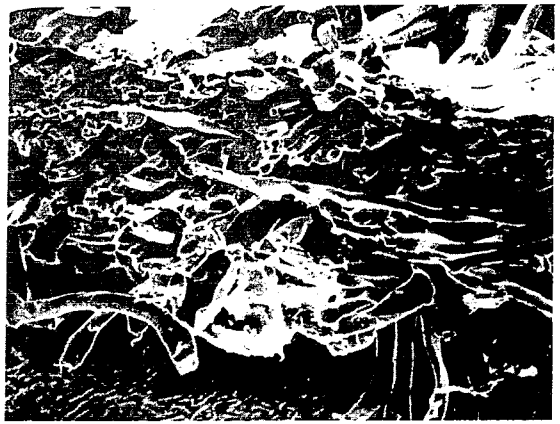
FIG. 3 is a photograph of a freshly cut edge at 100X magnification of a nonwoven fabric fused on both sides produced in accordance with the prior art.

One of the more common techniques for fusing a nonwoven batt of synthetic fibers is to pass the batt over one or more heated rolls which essentially fuses the fibers on the surface of the batt which is in contact with the heated roll or rolls. This type of fusion causes the fibers on the surface of the batt to flatten the fibers and thus deform the cross-section of the fibers due to the temperature and pressure to which the fibers are subjected. In FIG. 3 the fabric produced by lapping webs to form a batt, needling the batt, and fusing the needled batt on both sides with heated rolls shows both the flattened cross-section of fibers with originally a round cross section and also that essentially the fibers on the surface of the batt are fused.

Figure 4:
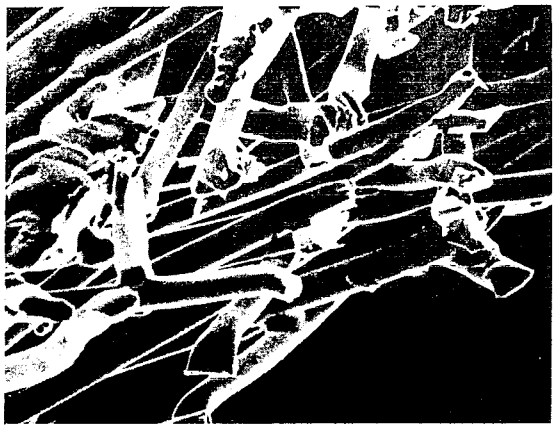
FIG. 4 is a photograph of a freshly cut edge at 200X magnification of a nonwoven fabric fused on one side only and produced in accordance with the apparatus of FIGS. 1 and 2.
Figure 5:
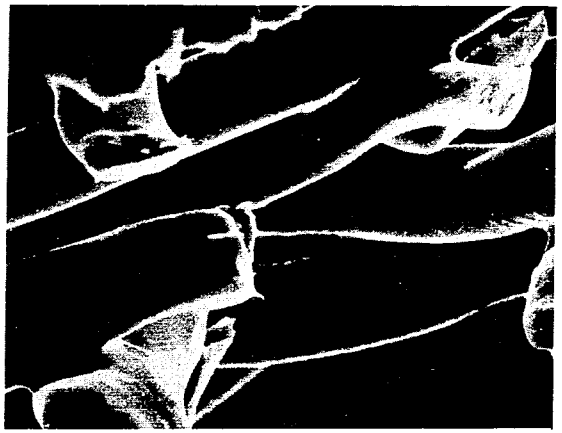
FIG. 5 is a exploded view at 700X magnification of the central portion of the fabric shown in FIG. 4 as indicated therein.

A fabric produced in accordance with the invention shown in FIGS. 1 and 2 and fused on one side by infrared radiation in accordance with another aspect of the invention is shown in FIGS. 4 and 5. It is readily apparent that the integrity of the round fiber cross-section is maintained and that fusion occurs all the way through the fabric, even though only one side of the batt was subjected to infrared radiation. FIG. 5 in particular shows the excellent fiber-to-fiber bonding through use of infrared radiation. The depth of fusion is controlled by controlling the speed of the fabric, the distance of the infrared source from the fabric and the temperature of the infrared source.

In some applications it is desirable to use a fabric which is completely fused, that is, a fabric in which fused fibers are found all the way through the fabric. In addition, it is often desirable that such a fused fabric have a nap surface. An example of where a fully fused fabric having a nap surface is useful is in the production of a vinyl laminate. The nap surface provides a far superior surface for bonding with the vinyl film to produce a laminate than does a smooth surface. The fully fused fabric has improved strength and dimensional stability as compared to a partially fused fabric and by using infrared radiation on only one side to fuse the fabric, the depth of fusion can be controlled to fully penetrate the fabric and still provide a nap surface on the side of the fabric opposite the infrared heater. Only the present invention of using infrared radiation to fuse a nonwoven batt produces a fully fused fabric with a nap surface. It is very difficult at best to obtain a fully fused fabric using two heated rolls because the center of the fabric generally does not fuse, as shown in FIG. 3. Of course, subjecting both surfaces of the fabric to a heated roll does not produce a fabric having a nap surface. A hot fluid chamber normally fuses both surfaces of the fabric; thus only the present invention produced a fully fused fabric with a nap surface.

Quartz heaters and foil-strip heaters have been used as the infrared radiation source in accordance with the present invention; however, the present invention is not limited by the particular source used to subject the fabric to the infrared radiation. At the present time it appears that the foil-strip heaters are preferred because they provide better control of the fusion process.

In general, fabrics with a variety of widths can be produced in accordance with the present invention; however, the invention is particularly applicable for the production of wide, nonwoven fabrics, that is, fabrics having a width ranging from about 108 to 230 inches. Usually the fabrics weigh at least from about ½ ounce per square yard.

EXAMPLES

Three different nonwoven fabrics were produced to demonstrate the improved fabric of the present invention. Two of the fabrics were produced by processes known in the art and labeled Control I and Control II. The third fabric was produced in accordance with the invention and labeled Inventive Fabric. All three fabrics were made using polypropylene staple having a length of 4 inches and a denier of 3.

Control I fabric was produced by crosslapping webs on an apron which was covered with warp threads to form a batt, needling the batt and fusing the needled batt on one side using a heated roll.

Control II fabric was produced by crosslapping webs to form a batt as in the production of the Control I fabric but without the use of warp threads, drafting the batt in the warp direction, needling the warp-drafted batt, and fusing the needled batt on one side using a heated roll.

The inventive fabric was produced in accordance with the process and apparatus of the invention as shown in FIGS. 1 and 2. No warp threads were used. The fabric was fused by subjecting the batt to infrared radiation on one side of the fabric while the fabric was under tension in the fill direction. A comparison of the properties of the fabrics is shown in Table I below:

TABLE I

| | Control I | Control II | Inventive Fabric |
|---|---|---|---|
| Wt. oz/yd$^2$ | 3.3 | 3.26 | 3.19 |
| Tear Strength[a], lbs. | | | |
| Warp | 16.7 | 27 | 26 |
| Fill | 23.0 | 22.8 | 37.7 |
| Breaking Strength[b], Lbs. | | | |
| Warp | 45 | 63 | 66 |
| Fill | 76 | 65 | 95.3 |
| Elongation[c] at 5 Lbs., % | | | |
| Warp | 6.6 | 11.0 | 3.1 |
| Fill | 2.0 | 24.2 | 1.8 |
| Elongation[d] at 20 Lbs., % | | | |
| Warp | 52.6 | 45.2 | 28.9 |
| Fill | 15.9 | 80.3 | 12.1 |
| Ultimate Elongation[e], % | | | |
| Warp | 110.4 | 100.8 | 55 |
| Fill | 80.9 | 133.6 | 62.9 |
| Tear Strength[f] at 3.5 oz/yd$^2$ | | | |
| Warp | 17.7 | 29 | 28.5 |
| Fill | 24.4 | 24.5 | 41.4 |
| Breaking Strength[g] at 3.5 oz/yd$^2$ | | | |
| Warp | 47.7 | 67.6 | 72.4 |
| Fill | 80.6 | 69.8 | 104.6 |

[a]ASTM D 2261-64T
[b]ASTM D 1682-64
[c]ASTM D 1682-64
[d]ASTM D 1682-64
[e]ASTM D 1682-64
[f]Calculated from breaking strength data
[g]Calculated from breaking strength data The data show that the properties of Inventive Fabric in both the warp and fill directions are superior to the properties of the Control I fabric in all aspects. The properties of the Inventive Fabric as compared to those of the fabric of the Control II process also indicate the superiority of the Inventive Fabric. The properties of the Inventive Fabric and the Control II fabric in the warp direction were approximately the same with the exception of the elongation values which were much better for the Inventive Fabric. The properties of the Inventive Fabric in the fill direction as compared to those of the Control II fabric were superior in all areas. The fact that the properties of the Inventive Fabric were equal to or greater than the properties of the the Control II fabric in the warp direction was surprising because the processes are the same up to the second warp-drafting step of the inventive process and one would expect that if the properties of the Control II fabric were improved in the fill direction, the properties of the fabric in the warp direction would suffer to some extent. It is also surprising that the elongation values in both the warp and fill directions were much better in the Inventive Fabric as compared to the Control II Fabric since one would normally anticipate that only the elongation values in the fill direction would show an improvement because of the similarity of the processes. Clearly the second warp-drafting step and the fill-drafting step provide an unexpected improvement in the properties of the fabric in both the warp and fill directions as compared to a fabric produced by a process identical to the inventive process except for the second warp-drafting step, the fill-drafting step and the fusion method.

The improvement in elongation of the Inventive Fabric in both the warp and fill directions substantially improves the dimensional stability of the nonwoven fabric which is especially important where the fabric is used as a carpet backing material. In addition to the improved elongation and strength properties of the Inventive Fabric, the fabric displayed a marked improvement in fabric uniformity and had an improved tuft bind in carpet applications.

That which is claimed is:

1. A method for fusing the fibers of a nonwoven batt of synthetic fibers having a longitudinal direction and a transverse direction wherein the depth of fusion is controlled and the integrity of the fibers' cross-section is maintained after fusion comprising subjecting at least one side of the batt to infrared radiation to melt and fuse the fibers together until the desired depth of fusion is obtained wherein the nonwoven batt comprises synthetic fibers oriented primarily in the transverse direction and the batt is subjected to tension in said transverse direction simultaneously with infrared irradiation.

2. The method of claim 1 wherein the synthetic fibers are selected from the group consisting of polyolefins, polyesters, polyamides and mixtures thereof.

3. The method of claim 1 wherein the synthetic fibers are polypropylene.

4. The method of claim 1 wherein the synthetic fibers are polypropylene staple having a length ranging from about 1½ to about 10 inches and a denier ranging from about 1 to about 20.

5. The method of claim 1 wherein the synthetic fibers are polypropylene staple having a length ranging from 2½ to about 4 inches, a denier ranging from about 1.5 to about 8, and fibers are fused together throughout the entire thickness of the batt leaving nap on the side of the batt opposite the side subjected to the infrared radiation.

* * * * *